US008055159B2

(12) United States Patent
Hirai

(10) Patent No.: US 8,055,159 B2
(45) Date of Patent: Nov. 8, 2011

(54) LIQUID DEVELOPING APPARATUS AND IMAGE FORMING APPARATUS

(75) Inventor: Atsuto Hirai, Ikoma (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 606 days.

(21) Appl. No.: 12/287,846

(22) Filed: Oct. 14, 2008

(65) Prior Publication Data

US 2009/0097876 A1 Apr. 16, 2009

(30) Foreign Application Priority Data

Oct. 16, 2007 (JP) ..... 2007-268834

(51) Int. Cl.
*G03G 15/10* (2006.01)

(52) U.S. Cl. ..... 399/237; 399/239

(58) Field of Classification Search ..... 399/57, 399/233, 237, 239, 248, 348
See application file for complete search history.

(56) References Cited

U.S. PATENT DOCUMENTS 5,937,247 A * 8/1999 Takeuchi et al. ..... 399/237
2006/0034639 A1* 2/2006 Kamijo et al. ..... 399/237

FOREIGN PATENT DOCUMENTS

| | | |
|---|---|---|
| JP | 2000-235306 | 8/2000 |
| JP | 3521975 | 4/2004 |
| JP | 2006-072334 | 3/2006 |
| JP | 2006-243050 | 9/2006 |

* cited by examiner

*Primary Examiner* — David Gray
*Assistant Examiner* — Barnabas Fekete
(74) *Attorney, Agent, or Firm* — Brinks Hofer Gilson & Lione

(57) ABSTRACT

Provided are a liquid developing apparatus and an image forming apparatus, wherein a high-viscosity liquid developer layer is transferred sequentially from a developer supply member to a developer coating member and to the developer carrying member among rollers, and the developer supply width of the developer supply member is made smaller than the width of the developer coating member and greater than the width of the developer carrying member, whereby an occurrence of the area, at the end portions of the developer carrying member, where the volume of developer is uneven is reduced, and the liquid developer is prevented from wrapping around the end faces of the developer coating member, without making the apparatus complicated.

14 Claims, 4 Drawing Sheets

LIQUID DEVELOPING APPARATUS AND IMAGE FORMING APPARATUS

This application is based on Japanese Patent Application No. 2007-268834 filed on Oct. 16, 2007, in Japanese Patent Office, the entire content of which is hereby incorporated by reference.

TECHNICAL FIELD

The present invention relates to a liquid developing apparatus for developing an electrostatic latent image using the liquid developer carried by a developer carrying member, and an image forming apparatus using this liquid developing apparatus.

BACKGROUND

There is a widespread use of an image forming apparatus utilizing electrophotographic technology which employs toner to develop an electrostatic latent image formed on a photoreceptor and transfers the developed image on a sheet of paper. Specifically, such an image forming apparatus as an on-demand printing apparatus required to provide higher image quality and higher resolution has come to utilize the wet development method employing a liquid developer with toner having a diameter smaller than that in a dry developer.

In recent years, a proposal has been made of liquid developing apparatuses using a high-viscosity liquid developer wherein a solid toner made of resin and pigment is dispersed, in high concentration, in a liquid carrier which is an insulating liquid such as silicone oil.

When a liquid developer is used for development, it is preferred that a thin layer of liquid developer of the order of microns be formed on the developer carrying member such as a developing roller, and this thin-layered liquid developer should be brought in contact with a photoconductor. This arrangement is particularly preferred when high-viscosity liquid developer is employed.

To stabilize the image density, a very thin layer of liquid developer is required to be uniformly formed on the developing roller. One of the techniques proposed so far for forming this thin layer of developer is a method of using a coating roller wherein the liquid developer on the coating roller is applied onto the developing roller under predetermined conditions. Further, a technique of using a supply roller is proposed to supply a predetermined volume of liquid developer to the coating roller.

To be more specific, a supply roller is used to supply a predetermined volume of liquid developer to the coating roller, and a thin layer of liquid developer is formed while the developer is conveyed by the coating roller, and then, the developer is transferred onto the developing roller. The developing roller brings a thin layer of liquid developer in contact with the photoconductor, whereby an electrostatic latent image is developed on the photoconductor.

When the liquid developer is transferred from roller to roller, the problem is in the behavior of the liquid developer on both ends of the roller in the longitudinal direction (across the width). Thus, it is important to determine whether the liquid developer is to be transferred on the entire surface across the roller or is to be transferred on both ends of the roller across the width with a margin of safety.

For example, when the liquid developer is to be transferred from a narrower (shorter) roller A to a wider (longer) roller B, a line-shaped area, where a lot of liquid developer exists, is formed the part, of the roller B, opposed to both ends of the roller A—i.e., both ends of the developer layer to be supplied. This is caused by the liquid developer wrapping around the end faces on both ends of the roller A, or the liquid developer wrapping around the end faces on both ends of the roller A, in the nip portion between the roller A and roller B, by surface tension.

If the liquid developer is transferred to another roller with the liquid developer unevenly formed, the unevenness still remains on that roller, with the result that the unevenness will remain uncorrected at the time of development.

Conversely, when the liquid developer is to be transferred from a wider (longer) roller B to a narrower (shorter) roller A, an uneven area does not occur to the transferred liquid developer. However, the liquid developer on the surface of the roller B spreads to the end faces of both ends of the roller A and sticks there. The liquid developer sticking to the end faces of both ends of roller A is spread to reach the shaft portion of the roller A by the repeated rotation/stop operations of the roller A. It is further spread in the axial direction, and the liquid developer eventually reaches the bearing section and leaks out of the development apparatus or enters the bearing section, thereby causing troubles.

To avoid this problem, it may be possible to provide both ends of the roller with a sealing member for preventing the developer from spreading. However, provision of many rollers with sealing members will complicate the apparatus structure and will increase the cost.

The Japanese Patent No. 3521975 discloses an apparatus wherein the liquid developer is sequentially transferred using a plurality of coating rollers. This apparatus is structured in such a way that the width of the coating roller is gradually reduced. However, for many rollers in this structure, there is required some measures such as a seal member in order to prevent the liquid developer from wrapping around the end faces on the ends of the rollers.

In the Japanese Unexamined Patent Application Publication No. 2006-72334, the width of the developing roller is smaller than that of the coating roller (measuring roller). Further, use of a plurality of measuring rollers is also mentioned, but this is based on the same concept as that of the aforementioned Japanese Unexamined Patent Application Publication No. 3521975. Thus, similar problems remain to be solved.

According to the technique disclosed in the Japanese Unexamined Patent Application Publication No. 2006-243050, an anilox roller is used as the coating roller, and the width of the anilox roller pattern, namely, the width of the liquid developer supply area is designed smaller than that of the developing roller. Since a liquid developer is not transferred to the entire surface of the developing roller, the liquid developer on the developing roller may be uneven.

According to the technique described in the Japanese Unexamined Patent Application Publication No. 2000-235306, the width of the coating roller is greater than that of the developing roller, and the width of the area wherein the liquid developer is coated by the coating roller is smaller than that of the developing roller. In this arrangement, the width of the liquid developer to be transferred is smaller than that of the developing roller. This may cause the liquid developer on the developing roller to be uneven.

SUMMARY

An object of the present invention is to solve the aforementioned technical problems of the prior art and to provide a liquid developing apparatus and image forming apparatus capable of forming a uniform liquid developer layer on a developer carrying member, thereby solving the problems of the complicated apparatus structure and increased costs.

In view of forgoing, one embodiment according to one aspect of the present invention is a liquid developing apparatus, comprising:

a developer carrying member which is adapted to carry liquid developer for developing an electrostatic latent image;

a coating member which is adapted to coat a surface of the developer carrying member with liquid developer, and has a width greater than a width of the developer carrying member; and a supplying mechanism which is adapted to supply liquid developer to the coating member over a width which is smaller than the width of the coating member and greater than the width of the developer carrying member.

According to another aspect of the present invention, another embodiment is an image forming apparatus, comprising:

an image carrying member;

an image forming mechanism which is adapted to form an electrostatic latent image on the image carrying member;

a developer carrying member which is adapted to carry liquid developer for developing the electrostatic latent image on the image carrying member;

a coating member which is adapted to coat a surface of the developer carrying member with liquid developer, and has a width greater than a width of the developer carrying member; and a supplying mechanism which is adapted to supply liquid developer to the coating member over a width which is smaller than the width of the coating member and greater than the width of the developer carrying member.

DETAILED DESCRIPTION OF THE PREFERRED EMBODIMENTS

The following describes an embodiment of the present invention with reference to drawings:

The wet image forming apparatus that uses a thin layer of liquid developer to perform development is used in a photocopier, simplified printing machine and printer. An image forming process based on electrophotographic technology is commonly employed for this purpose. A wet image forming apparatus based on electrophotographic technology will be explained as a present embodiment.

(Structure and Operation of Image Forming Apparatus)

Figure 1:
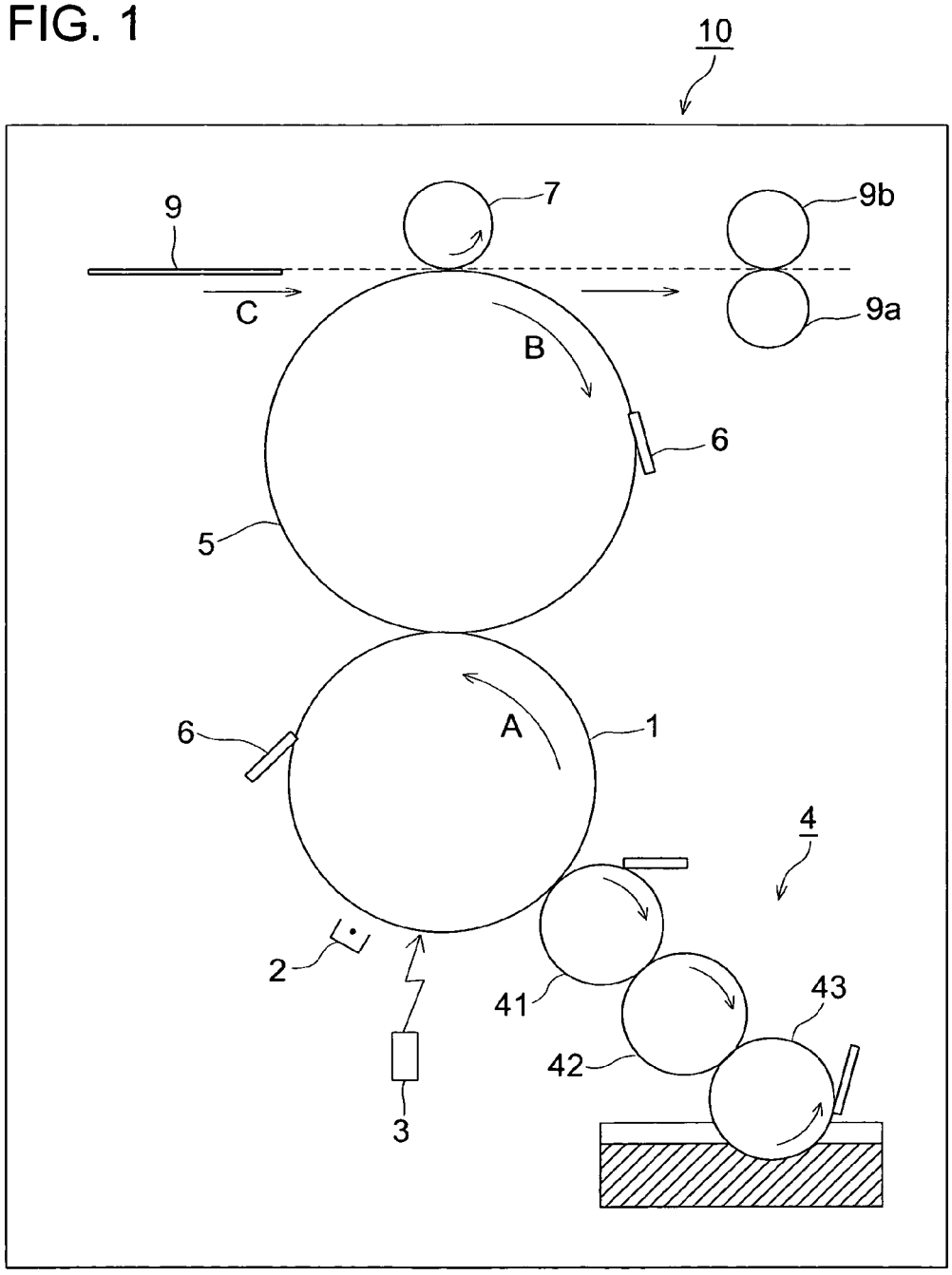
FIG. 1 is a diagram showing the overall schematic structure of an image forming apparatus as an embodiment of the present invention.

FIG. 1 shows the overall schematic structure of an image forming apparatus according to an embodiment of the present invention. The components related to the feed, conveyance and ejection of the recording medium will be shown schematically.

An image forming apparatus 10 of FIG. 1 is provided with a photoconductor drum 1 as an image carrying member, a charging device 2, an exposure device 3, a liquid developing apparatus 4 and a cleaning device 6. The image forming apparatus 10 also includes an intermediate transfer roller 5 as an intermediate transfer member, and a secondary transfer roller 7.

In FIG. 1, only one liquid developing apparatus 4 is arranged. However, a plurality of liquid developing apparatuses can be mounted to form a color image. A color development method and the presence or absence of the intermediate transfer can be selected as desired. A desired arrangement can be configured to conform to this selection.

The photoconductor drum 1 has a photoconductor layer on the surface and is designed in a cylindrical shape. It rotates in the direction of arrow A in FIG. 1. The charging device 2, exposure device 3, liquid developing apparatus 4, intermediate transfer roller 5 and cleaning device 6 are sequentially arranged on the outer periphery of the photoconductor drum 1 along the rotating direction A of the photoconductor drum 1.

The charging device 2 charges the surface of the photoconductor drum 1 to a predetermined potential.

The exposure device 3 radiates light on the surface of the photoconductor drum 1 to reduce the charging level in the irradiated area, an thereby forming an electrostatic latent image.

The liquid developing apparatus 4 develops the electrostatic latent image formed on the photoconductor drum 1. To be more specific, the liquid developer is conveyed to the development area of the photoconductor drum 1, and the toner contained in the liquid developer is supplied to the electrostatic latent image on the surface of the photoconductor drum 1, whereby a toner image is formed.

In the development process, the development bias voltage of the same polarity as toner is applied to the developing roller 41 of the liquid developing apparatus 4 from a power source. Similarly, the difference in electric field is formed by the difference between the potential of the electrostatic latent image on the photoconductor drum 1 having the same polarity as the toner, and the development bias. According to potential of the electrostatic latent image, the toner in the liquid developer is attached on the photoconductor drum 1, and the electrostatic latent image on the photoconductor drum 1 is developed.

The intermediate transfer roller 5 is arranged opposed to the photoconductor drum 1, and is rotated in the direction of arrow B while keeping contact with the photoconductor drum 1. A primary transfer from the photoconductor drum 1 to the intermediate transfer roller 5 is performed in the nip portion between the intermediate transfer roller 5 and photoconductor drum 1.

In the primary transfer process, the transfer bias voltage of a polarity opposite to that of the toner is applied to the intermediate transfer roller 5 from a power source. This forms an electric field between the intermediate transfer roller 5 and photoconductor drum 1 in the primary transfer region. Then the toner image on the photoconductor drum 1 is attracted by the intermediate transfer roller 5 and is transferred onto the intermediate transfer roller 5.

When the toner image has been transferred onto the intermediate transfer roller 5, the cleaning device 6 removes the remaining toner from the photoconductor 1 to prepare for formation of the next image.

The intermediate transfer roller 5 and secondary transfer roller 7 are arranged with the conveyance path, for the recording medium 9, sandwiched in-between. The nip portion between the intermediate transfer roller 5 and secondary transfer roller 7 provides the secondary transfer of the toner image from the intermediate transfer roller 5 to the recording medium 9.

The recording medium 9 is fed to the secondary transfer position in the direction of arrow C at an exact timing for the secondary transfer.

In the secondary transfer process, the transfer bias voltage of a polarity opposite to that of the toner is applied to the secondary transfer roller 7 from a power source. This forms an electric field between the intermediate transfer roller 5 and secondary transfer roller 7. The toner image on the intermediate transfer roller 5 is attached to the recording medium 9 having been fed between the intermediate transfer roller 5 and secondary transfer roller 7, and is transferred onto the recording medium 9. After the secondary transfer, the surface of the intermediate transfer roller is cleaned by the cleaning member 6.

The fixing section is provided with a pair of fixing rollers 9*a* and 9*b* which are arranged opposite to each other and are rotated in contact with each other. Each of the fixing rollers 9*a* and 9*b* is provided with a heat source. When the recording medium 9 passes through the fixing rollers 9*a* and 9*b*, pressure is applied to the toner image on the recording medium 9 at a high temperature. Thus, the toner forming a toner image is fused onto the recording medium 9 to be fixed thereon.

(Structure of Liquid Developer)

The liquid developer is made up of a liquid carrier as a solvent and colored toner particles dispersed in high density therein. An additive such as dispersant or charge regulating agent can be added to the liquid developer, if desired.

The insulating solvent which is nonvolatile at the normal temperature is preferably used as a liquid carrier. For example, silicone oil, mineral oil and paraffin oil can be used as a nonvolatile solvent.

The toner particle is mainly made up of a resin and a pigment or dye for coloring. The resin has a function of uniformly dispersing the pigment or dye in the resin, and a function as a binder at the time of fixing on the recording medium.

As a resin for toner particles, there can be used, for example, a thermoplastic resin such as a polystyrene resin, styrene-acryl resin, acryl resin, polyester resin, epoxy resin, polyamide resin, polyimide resin and polyurethane resin. Further, a mixture of a plurality of these resins can be used.

Pigment and dyes commonly available on the market can be used to color the toner. For example, carbon black, red oxide, titanium oxide, silica, phthalocyanine blue, phthalocyanine green, sky blue, benzidine yellow or lake red D can be used as a pigment. As a dye, solvent red 27 or acid blue 9 can be used for example.

A commonly used method can be employed to prepare the liquid developer. For example, resins and pigments are melted and kneaded at a predetermined compounding ratio by a pressure kneader or roll mill. Then they are dispersed uniformly, and are fine-pulverized by a jet mill, for example. Further, the fine powder having been obtained is classified by an air classifier or the like, whereby colored toner particles having a predetermined particle size can be obtained. Then the toner particle having been obtained is mixed with the insulating liquid as a liquid carrier at a predetermined compounding ratio. By uniformly dispersing the toner particles in this mixture by a dispersing device such as a ball mill, a liquid developer is obtained.

The volume average particle diameter of the toner is preferably in the range of 0.1 μm or more without exceeding 5 μm. If the average particle diameter of the toner is below 0.1 μm, development performances may substantially decrease. In the meantime, if the average particle size exceeds 5 μm, the image quality may deteriorate.

The percentage by mass of toner particles with respect to liquid developer is preferably in the range from 10 through 50%. If it is below 10%, the toner particle tends to precipitate. This may raise a problem with chronological stability at the time of long-term storage. Further, to get the required image density, a large quantity of liquid developer must be supplied. This will increase the amount of liquid carrier deposited on the recording medium. Thus, a large quantity of liquid carrier tends to evaporate at the time of fixing. This may cause an environmental problem. If this percentage exceeds 50%, the viscosity of liquid developer will be too high. This may raise difficulties with production or usage.

The viscosity of the liquid developer is preferably in the range of 0.1 m Pa·s or more without exceeding 10000 m Pa·s at 25° C. If it exceeds 10000 m Pa·s, problems tend to occur in handling such as stirring or feeding of the developer, and this may cause the apparatus to bear a heavier load in ensuring a uniform liquid developer.

(Structure and Operation of Liquid Developing Apparatus)

Figure 2:
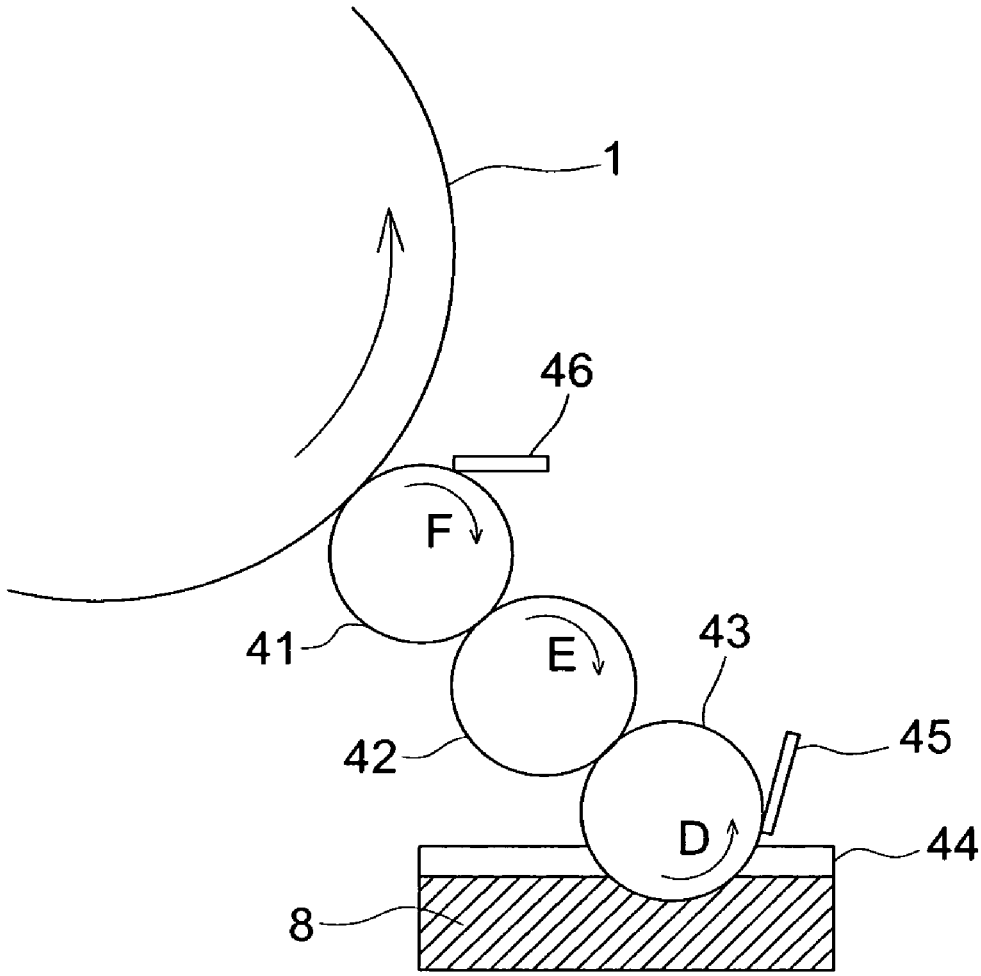
FIG. 2 is a diagram showing the schematic structure of a liquid developing apparatus 4 of FIG. 1.

FIG. 2 shows the schematic structure of the liquid developing apparatus 4.

The developer container 44 accommodates a liquid developer 8.

The supply roller 43 as a developer supply member is arranged to be partly immersed in the liquid developer 8 within a developer container 44. Rotating in the direction of arrow D, the supply roller 43 pumps up the liquid developer 8 from the developer container 44. The high-viscosity liquid developer 8 is pumped up by sticking to the surface of the supply roller 43 by its adhesion force.

The regulating member 45 is arranged opposed to the supply roller 43 in contact with the supply roller 43 in the counter direction with respect to the rotating direction, whereby the volume of the liquid developer on the surface of the supply roller 43 is regulated. The unwanted amount of liquid developer is removed by the regulating member 45, and a thin layer of liquid developer is thereby formed on the surface of the supply roller 43, and is conveyed.

It is preferred that an anilox roller with a groove formed on its surface should be used as the supply roller 43, and the volume of the developer should be uniformly regulated by the metallic regulating member 45. A solid metallic roller or a roller using a NBR or a metallic bar with urethane rubber layer formed thereon can be employed as the supply roller 43.

The coating roller 42 as the developer coating member is arranged opposed to the supply roller 43. Being in contact with the supply roller 43, the coating roller 42 rotates in the direction of arrow E. A thin layer of liquid developer formed on the surface of the supply roller 43 is transferred onto the surface of the coating roller 42 at the nip portion thereof, and is conveyed.

A rubber roller with a rubber layer formed on a metallic cored bar is preferably used as the coating roller 42. The NBR or the urethane resin, or the same coated with urethane resin or fluorine resin can be used as the rubber. Further, when a rubber roller is used as the supply roller 43, a metallic roller can be used as the coating roller 42.

The developing roller 41 as the developer carrying member is placed opposed to the coating roller 42. Being in contact with the coating roller 42, the developing roller 41 rotates in the direction of arrow F. A thin layer of liquid developer formed on the surface of the coating roller 42 is scraped off by the developing roller 41 at the nip portion therebetween. Then the thin layer of liquid developer is transferred onto the surface of the developing roller 41.

The surface traveling direction of the developing roller 41 in the position wherein the developing roller 41 is kept in contact with the coating roller 42 is reverse to the surface traveling direction of the coating roller 42. This arrangement allows a uniform layer of the liquid developer 8 to be formed on the developing roller 41. A rubber roller of low hardness is preferably used as the developing roller 41, similarly to the case of the coating roller 42.

The developing roller 41 is also kept in contact with the photoconductor drum 1 as an image carrying member, and a nip portion is formed between them. The thin layer of liquid developer conveyed to the nip portion, i.e., the development area, develops the electrostatic latent image on the photoconductor 1.

After the electrostatic latent image on the photoconductor drum 1 has been developed, a part of the liquid developer remains on the surface of the developing roller 41. If the remaining liquid developer is again conveyed to the development area, the next step of development may be adversely affected. A cleaning member 46 is a blade provided to clean the surface of the developing roller 41, and removes the liquid developer remaining after development.

In the present embodiment, although a supply roller, coating roller and developing roller are used, they do not need to have a roller form. They can be designed in the form of a belt or others.

(Behavior of Liquid Developer at End of Rollers)

Figure 3B:
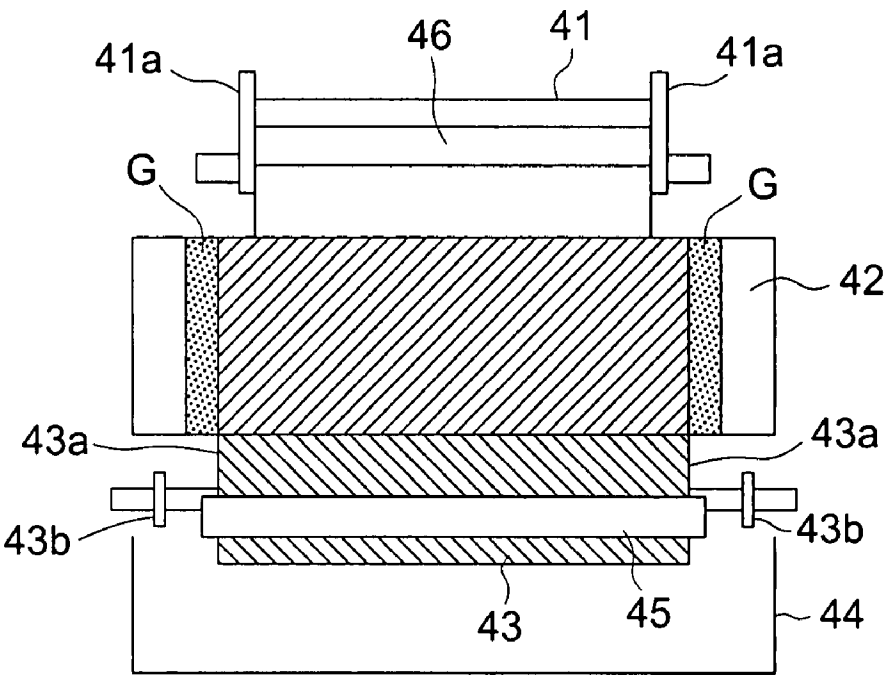
FIG. 3*b* is a diagram showing a liquid developing apparatus 4 as viewed from the direction X of FIG. 3*a;*
Figure 3A:
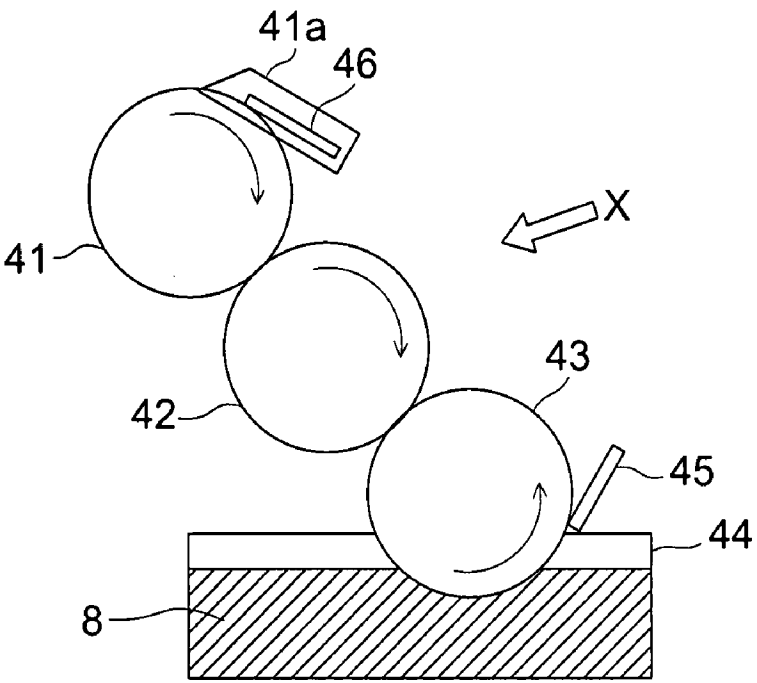
FIG. 3*a* is a cross sectional view showing the schematic structure of the liquid developing apparatus 4.

FIG. 3*a* is a cross sectional view showing the schematic structure of the liquid developing apparatus 4, and FIG. 3*b* is a diagram showing a liquid developing apparatus 4 as viewed from the direction X of FIG. 3*a;*

The liquid developer 8 pumped up from the developer container 44 by the supply roller 43 is regulated to have a predetermined thickness by the regulating member 45 and is conveyed toward the coating roller 42.

When the liquid developer 8 is supplied from the supply roller 43 to the coating roller 42, a liquid developer supply width, which is the width of the supplied liquid developer, is set to be the same as or smaller than the entire width of the supply roller 43. For example, when the aforementioned anilox roller is used as the supply roller 43, the width of the groove-patterned portion on the surface is set smaller, whereby the liquid developer supply width can be made smaller than the width of the supply roller 43.

In the present embodiment, a part of the supply roller 43 is dipped in the liquid developer 8 accommodated in the developer container 44. The liquid developer supply width thereof is the entire width of the surface. The liquid developer 8 also adheres to the end faces on both ends 43*a* of the supply roller 43.

In order to uniformly regulate the liquid developer over the entire liquid developer supply width, namely, over the entire supply roller, the regulating member 45 is designed longer than the supply roller 43. A part of the liquid developer 8 having been regulated by the regulating member 45 moves to the end faces on both ends 43*a* of the supply roller 43 and adheres thereto.

As described above, in the supply roller 43, the liquid developer 8 is kept adhering to the end faces on both ends 43*a* by the immersion in the liquid developer 8 or by the regulation of the regulating member 45. To prevent this liquid developer from moving outwardly along the shaft of the supply roller 43, a disk-shaped spread-preventing member 43*b* is provided on the shaft of the supply roller 43.

The liquid developer 8 falls downward when it has reached the spread-preventing member 43*b*. Thus, this does not spread over to the external shaft portion. The developer container 44 is provided to recover the liquid developer 8 falling downward.

In the meantime, the liquid developer 8 adhering to the end faces on both ends 43*a* of the supply roller 43 is fed to the nip portion between the coating roller 42 and the supply roller 43 by the rotation of the supply roller 43. The width of the coating roller 42 is greater than the liquid developer supply width, namely, the width of the supply roller 43, and thus, a part of the liquid developer 8 on the end faces on both ends 43*a* of the supply roller adheres to the surface of the coating roller 42 by the surface tension.

This arrangement ensures that the area containing much liquid developer 8 (area G of FIG. 3*b*) is formed on the portion of the coating roller 42 opposed to both ends of the supply roller 43.

Along with the supply of the liquid developer 8 to this area G from the supply roller 43, recovery of the liquid developer to the supply roller 43 arises if the volume of the liquid developer supplied to the area G increases to a certain extent. Accordingly, there is no continuing expansion of the area G. The area G is kept stable within a predetermined range.

The width of the coating roller 42 is designed to expand outside the area G. This arrangement prevents the liquid developer 8 from spreading to the end faces on both ends of the coating roller 42, and also prevents the liquid developer 8 from reaching the shaft of the coating roller 42. Thus, a sealing member or the like does not need to be provided on the shaft of the coating roller 42.

If the area G on the coating roller 42 is applied to the surface of the developing roller 41, there will be unevenness in the volume of the liquid developer on the developing roller 41. This will have an adverse effect on the density of the developed image.

To avoid this, the width of the developing roller 41 is designed to be smaller than the liquid developer supply width. This arrangement allows a uniform thin layer of liquid developer to be formed on the surface of the developing roller 41, without the developing roller 41 being coated with the liquid developer in the area G of the coating roller 42.

In the nip portion between the coating roller 42 and developing roller 41, the liquid developer 8 tends to stick to the end faces on both ends faces of the developing roller 41 from the surface of the coating roller 42. Further, the developing roller 41 is provided with a cleaning member 46 across the entire width of the developing roller 41 to remove the liquid developer 8 remaining after development.

When the liquid developer 8 on the developing roller 41 is being removed by the cleaning member 46, the liquid developer 8 tends to wrap around both ends of the developing roller 41 to stick to the end faces of the developing roller 41.

To prevent the liquid developer 8 from spreading to the end faces on both ends of the developing roller 41, sealing members 41*a* are installed on both ends of the developing roller 41. These sealing members 41*a* ensure that the liquid developer 8 blocked by the cleaning member 46 is fed over the cleaning member 46 without spreading to the end faces on both ends and is recovered.

The liquid developer 8 sticking to the end faces on both ends of the developing roller 41 from the surface of the coating roller 42 is also recovered by this sealing member 41*a*. A film made of resin such as PET, rubber or sponge is used as the sealing member 41*a*.

The cleaning member 46 may be designed to be as wide as the developing roller 41, and sealing members 41*a* may be provided on both ends thereof, alternatively, the cleaning member 46 is designed to be wider than the developing roller 41 so as to penetrate into the sealing member 41*a*. Instead, the liquid developer 8 sticking to the end faces on both ends of the developing roller 41 may be scraped off by pieces of PET film or the like on the downstream side from the cleaning member 46.

In the configuration where a high-viscosity thin layer of liquid developer is transferred from the supply roller 43 to the coating roller 42 and developing roller 41 one after another, the liquid developer supply width of the supply roller 43 is made smaller than the width of the coating roller 42, and is greater than the width of the developing roller 41. This arrangement prevents the liquid developer from being uneven on the developing roller 41 without making the apparatus more complicated.

The supply roller 43 is provided with spread-preventing members 43*b*, and the developing roller 41 is provided with sealing members 41*a*. The spread-preventing members 43*b* and sealing members 41*a* are necessarily installed when the regulating member 45 and cleaning member 46 have been installed, respectively. In the present embodiment, a sealing member or a spread-preventing member does not need to be provided on the coating roller 42.

Although only one supply roller 43 is used as the developer supply member in the above description, a plurality of supply rollers can be used.

In that case, the width of the rollers is preferably the same or becomes greater in the course of the transfer of the liquid developer from one roller to another among the plurality of rollers. To be more specific, it is preferred that the width of the supply roller on the supplying side is not greater than that of the supply roller on the receiving side.

This structure eliminates the need of installing a spread-preventing member 43*b* for the supply rollers other than the supply roller 43 having a regulating member 45 to regulate the liquid developer.

Further, if an uneven area similar to the aforementioned area G arises in the supply rollers 43, it is transferred to the coating roller 42, but not to the last developing roller 41.

In the present embodiment, the above description refers to the case wherein the surface of the coating roller 42 moves in the direction reverse to the surface of the developing roller 41 in the nip portion. It is also possible to design the structure such that the surface of the coating roller 42 moves in the same direction as the surface of the developing roller 41 in the nip portion.

To verify the aforementioned advantages, an experiment was conducted, where the coating roller 42 was made 10 mm longer and the developing roller 41 was made 4 mm shorter than the supply roller 43. Then, a uniform liquid developer layer was observed on the developing roller 41 without the liquid developer 8 sticking to the end faces on both ends of the coating roller 42.

Figure 4B:
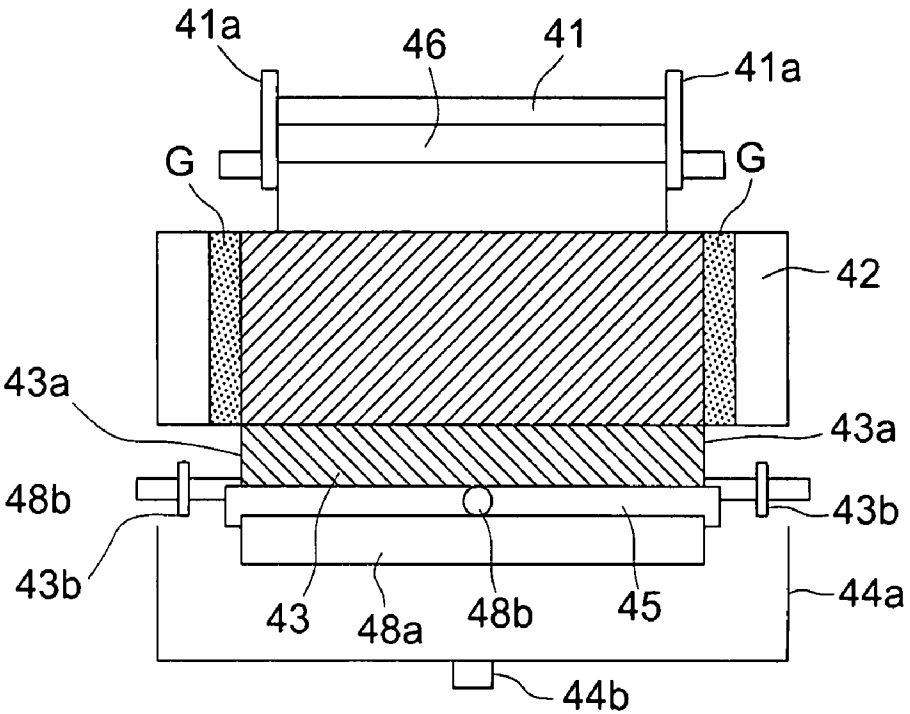
FIG. 4*b* is a diagram showing the liquid developing apparatus 4 viewed from the direction X of FIG. 4*a*.
Figure 4A:
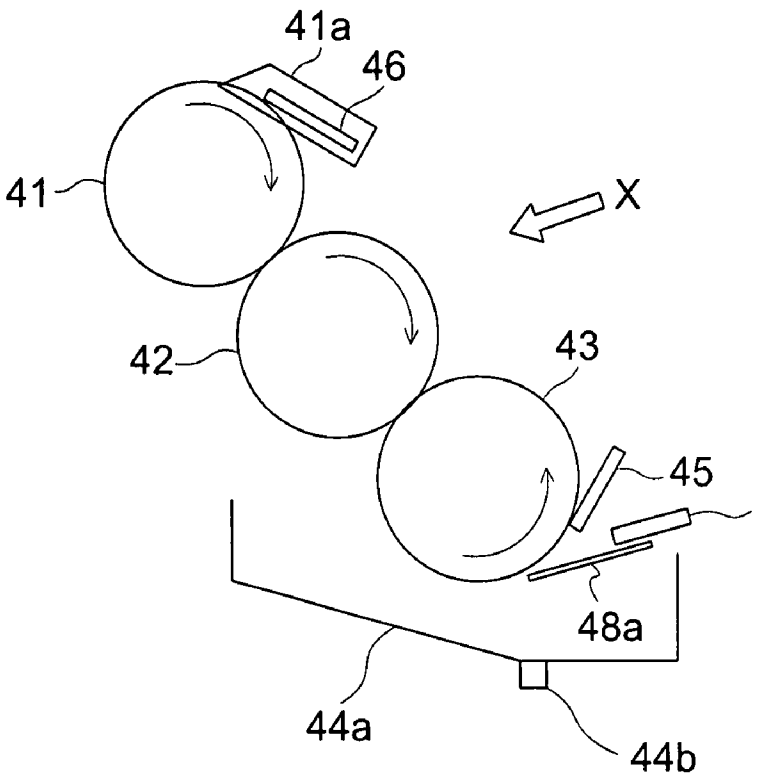
FIG. 4*a* is a cross sectional view showing another schematic structure of the liquid developing apparatus 4.

FIG. 4*a* is a cross sectional view showing another schematic structure of the liquid developing apparatus 4. FIG. 4*b* is a diagram showing the liquid developing apparatus 4 as viewed from the direction X of FIG. 4*a*. The following describes the differences from FIGS. 3*a* and 3*b*, without the same portions being mentioned.

In the liquid developing apparatus of FIGS. 3*a* and 3*b*, the supply roller 43 is partly immersed in the liquid developer 8 stored in the developer container 44. Alternatively, in a liquid developing apparatus of FIGS. 4*a* and 4*b*, liquid developer 8 is supplied to a supply roller 43 through a tube.

A liquid supply auxiliary member 48*a* is installed on the upstream side in the rotating direction of the supply roller 43 below the regulating member 45. The liquid supply auxiliary member 48*a* can be formed of a thin plate having a thickness of about 0.1 mm.

The feed opening 48*b* of the tube that supplies the liquid developer is disposed above the liquid supply auxiliary member 48*a*. In FIGS. 4*a* and 4*b*, the feed opening 48*b* is arranged at one position. A plurality of these ports can be arranged at a plurality of positions.

The feed opening 48*b* of the tube is connected with the developer container through a pump. The liquid developer is supplied onto the liquid supply auxiliary member 48*a* from the developer container by the pump.

The developer supplied onto the liquid supply auxiliary member 48*a* spreads across the width on the liquid supply auxiliary member 48*a* and flows down to the supply roller 43. The liquid developer sticking to the supply roller 43 is fed upward by the rotation of the supply roller 43 and is regulated by the regulating member 45.

The subsequent formation of a thin layer of liquid developer is the same as that in FIGS. 3*a* and 3*b*.

The liquid developer flowing down from the liquid supply auxiliary member 48*a* without sticking to the supply roller is recovered by a tray 44*a* provided downward and is supplied to the developer container and others from a recovery port 44*b*.

Similarly to the case of FIGS. 3*a* and 3*b*, in the configuration where the high-viscosity liquid developer layer is transferred sequentially from the supply roller 43 to the coating roller 42 and the developing roller 41, the liquid developer supply width of the supply roller 43 is made smaller than that of the coating roller 42, and is made greater than that of the developing roller 41. This arrangement prevents the liquid developer on the developing roller 41 from being uneven without making the apparatus complicated.

According to the embodiment of the present invention, the liquid developer on the developer carrying member is made uniform without making the apparatus complicated or the cost higher.

It is to be expressly understood, however, that the present invention is not restricted to the aforementioned embodiment. The present invention can be embodied in a great number of variations with appropriate modification or additions without departing from the spirit and scope of the invention claimed.

What is claimed is:

1. A liquid developing apparatus, comprising:

a developer carrying member which is adapted to carry liquid developer for developing an electrostatic latent image;

a coating member which is adapted to coat a surface of the developer carrying member with liquid developer, and has a width greater than a width of the developer carrying member; and a supplying mechanism which is adapted to supply liquid developer to the coating member over a width which is smaller than the width of the coating member and greater than the width of the developer carrying member.

2. The liquid developing apparatus of claim 1, wherein the developer carrying member includes a developing roller.

3. The liquid developing apparatus of claim 1, wherein the coating member includes a coating roller.

4. The liquid developing apparatus of claim 1, wherein the supplying mechanism includes:

a developer container which is adapted to contain liquid developer therein; and a supplying roller which is configured such that a part of the supplying roller is to be immersed in the liquid developer in the developer container.

5. The liquid developing apparatus of claim 1, wherein the supplying mechanism includes:

a supplying roller which is adapted to supply liquid developer carried thereon to the coating member; and a tube having a feed opening through which liquid developer is to be supplied to a surface of the supplying roller.

6. The liquid developing apparatus of claim 1, further comprising:

a cleaning member which is provided in contact with a surface of the developer carrying member and is adapted to remove liquid developer remaining, on the surface of the developer carrying member, after development of the electrostatic latent image; and a sealing member which is provided on an end portion, in a width direction, of the developer carrying member and is adapted to prevent liquid developer from wrapping around an end face of the developer carrying member.

7. The liquid developing apparatus of claim 1, wherein the supplying mechanism includes:

a supplying roller which is adapted to supply liquid developer carried thereon to the coating member;

a regulating member which is provided in contact with a surface of the supplying roller to regulate a supply amount of liquid developer to be supplied to the coating member by the supplying roller; and a spread-preventing member which is adapted to prevent the liquid developer on the supplying roller from spreading from an end portion, in a width direction, of the supplying roller.

8. An image forming apparatus, comprising:

an image carrying member;

an image forming mechanism which is adapted to form an electrostatic latent image on the image carrying member;

a developer carrying member which is adapted to carry liquid developer for developing the electrostatic latent image on the image carrying member;

a coating member which is adapted to coat a surface of the developer carrying member with liquid developer, and has a width greater than a width of the developer carrying member; and a supplying mechanism which is adapted to supply liquid developer to the coating member over a width which is smaller than the width of the coating member and greater than the width of the developer carrying member.

9. The imager forming apparatus of claim 8, wherein the developer carrying member includes a developing roller.

10. The imager forming apparatus of claim 8, wherein the coating member includes a coating roller.

11. The imager forming apparatus of claim 8, wherein the supplying mechanism includes:

a developer container which is adapted to contain liquid developer therein; and a supplying roller which is configured such that a part of the supplying roller is to be immersed in the liquid developer in the developer container.

12. The imager forming apparatus of claim 8, wherein the supplying mechanism includes:

a supplying roller which is adapted to supply liquid developer carried thereon to the coating member; and a tube having a feed opening through which liquid developer is to be supplied to a surface of the supplying roller.

13. The imager forming apparatus of claim 8, further comprising:

a cleaning member which is provided in contact with a surface of the developer carrying member and is adapted to remove liquid developer remaining, on the surface of the developer carrying member, after development of the electrostatic latent image; and a sealing member which is provided on an end portion, in a width direction, of the developer carrying member and is adapted to prevent liquid developer from wrapping around an end face of the developer carrying member.

14. The imager forming apparatus of claim 8, wherein the supplying mechanism includes:

a supplying roller which is adapted to supply liquid developer carried thereon to the coating member;

a regulating member which is provided in contact with a surface of the supplying roller to regulate a supply amount of liquid developer to be supplied to the coating member by the supplying roller; and a spread-preventing member which is adapted to prevent the liquid developer on the supplying roller from spreading from an end portion, in a width direction, of the supplying roller.

* * * * *